US006794105B2

(12) United States Patent
Adin et al.

(10) Patent No.: US 6,794,105 B2
(45) **Date of Patent: *Sep. 21, 2004**

(54) RADIOGRAPHIC SILVER HALIDE FILM FOR MAMMOGRAPHY WITH REDUCED DYE STAIN

(75) Inventors: Anthony Adin, Rochester, NY (US); Stephen A. Hershey, Victor, NY (US); Robert E. Dickerson, Hamlin, NY (US)

(73) Assignee: Eastman Kodak Company, Rochester, NY (US)

( * ) Notice: Subject to any disclaimer, the term of this patent is extended or adjusted under 35 U.S.C. 154(b) by 43 days.

This patent is subject to a terminal disclaimer.

(21) Appl. No.: 10/440,749

(22) Filed: May 19, 2003

(65) Prior Publication Data

US 2004/0096768 A1 May 20, 2004

Related U.S. Application Data

(63) Continuation-in-part of application No. 10/299,123, filed on Nov. 19, 2002, now abandoned.

(51) Int. Cl.[7] ..... G03C 1/29; G03C 1/46; G03C 5/17

(52) U.S. Cl. ..... 430/139; 430/502; 430/509; 430/574; 430/966

(58) Field of Search ..... 430/139, 502, 430/509, 574, 966

(56) References Cited

U.S. PATENT DOCUMENTS

| | | | | | |
|---|---|---|---|---|---|
| 3,854,955 | A | * | 12/1974 | Shibe et al. | 430/574 |
| 4,172,730 | A | * | 10/1979 | Hinata et al. | 430/139 |
| 4,659,654 | A | * | 4/1987 | Metoki et al. | |
| 4,710,637 | A | * | 12/1987 | Luckey et al. | 250/486.1 |
| 5,041,366 | A | | 8/1991 | Asano et al. | |
| 5,380,636 | A | * | 1/1995 | Malfatto et al. | 430/502 |
| 5,455,139 | A | * | 10/1995 | Wada et al. | 430/502 |
| 5,738,981 | A | * | 4/1998 | Dickerson et al. | 430/509 |
| 5,759,754 | A | * | 6/1998 | Dickerson | 430/509 |
| 5,853,967 | A | * | 12/1998 | Dickerson | 430/502 |
| 5,998,083 | A | * | 12/1999 | Verbeeck et al. | 430/139 |
| 6,033,840 | A | * | 3/2000 | Dickerson | 430/502 |
| 6,037,112 | A | * | 3/2000 | Dickerson | 430/502 |
| 6,573,019 | B1 | * | 6/2003 | Zegel | 430/502 |
| 2002/0192607 | A1 | * | 12/2002 | Elst et al. | 430/139 |

FOREIGN PATENT DOCUMENTS

| | | |
|---|---|---|
| EP | 0 930 527 A1 | 7/1999 |
| EP | 1 103 848 A1 | 5/2001 |
| EP | 1 217 428 A1 | 6/2002 |
| EP | 1 246 000 A1 | 10/2002 |
| JP | 7-72577 | 3/1995 |

OTHER PUBLICATIONS

U.S. patent application Ser. No. 10/299,237, filed Nov. 19, 2002, titled *Radiographic Film For Mammography With Improved Processability*, by Dickerson et al.

U.S. patent application Ser. No. 10/299,765, filed Nov. 19, 2002, titled *Mammography Film And Imaging Assembly For Use With Rhodium Anodes*, by Dickerson et al.

U.S. patent application Ser. No. 10/299,941, filed Nov. 19, 2002, titled *Mammography Imaging Method Using High Peak Voltage*, by Dickerson et al.

U.S. patent application Ser. No. 10/299,759, filed Nov. 19, 2002, titled *Mammography Imaging Method Using High Peak Voltage and Rhodium or Tungsten Anodes* by Dickerson et al.

JP Abstract 07072577.

* cited by examiner

*Primary Examiner*—Richard L. Schilling
(74) *Attorney, Agent, or Firm*—J. Lanny Tucker

(57) ABSTRACT

A radiographic silver halide film useful for mammography comprises a support having a cubic grain silver halide emulsion on one side. The cubic grains are spectrally sensitized with a combination of first and second spectral sensitizing dyes that provides a combined maximum J-aggregate absorption of from about 540 to about 560 nm. The first spectral sensitizing dye is an anionic benzimidazole-benzoxazole carbocyanine and the second spectral sensitizing dye is an anionic oxycarbocyanine. The first and second spectral sensitizing dyes are present in a molar ratio of from about 0.25:1 to about 4:1.

22 Claims, No Drawings

RADIOGRAPHIC SILVER HALIDE FILM FOR MAMMOGRAPHY WITH REDUCED DYE STAIN

RELATED APPLICATION

This is a Continuation-in-part application of U.S. Ser. No. 10/299,123 filed Nov. 19, 2002 now abandoned, Dickerson, Hershey, and Adin.

FIELD OF THE INVENTION

This invention is directed to radiography. In particular, it is directed to a radiographic silver halide film that provides medical diagnostic images of soft tissues such as in mammography and exhibits reduced dye stain.

BACKGROUND OF THE INVENTION

The use of radiation-sensitive silver halide emulsions for medical diagnostic imaging can be traced to Roentgen's discovery of X-radiation by the inadvertent exposure of a silver halide film. Eastman Kodak Company then introduced its first product specifically that was intended to be exposed by X-radiation in 1913.

In conventional medical diagnostic imaging the object is to obtain an image of a patient's internal anatomy with as little X-radiation exposure as possible. The fastest imaging speeds are realized by mounting a dual-coated radiographic element between a pair of fluorescent intensifying screens for imagewise exposure. About 5% or less of the exposing X-radiation passing through the patient is adsorbed directly by the latent image forming silver halide emulsion layers within the dual-coated radiographic element. Most of the X-radiation that participates in image formation is absorbed by phosphor particles within the fluorescent screens. This stimulates light emission that is more readily absorbed by the silver halide emulsion layers of the radiographic element.

Examples of radiographic element constructions for medical diagnostic purposes are provided by U.S. Pat. No. 4,425,425 (Abbott et al.) and U.S. Pat. No. 4,425,426 (Abbott et al.), U.S. Pat. No. 4,414,310 (Dickerson), U.S. Pat. No. 4,803,150 (Kelly et al.), U.S. Pat. No. 4,900,652 (Kelly et al.), U.S. Pat. No. 5,252,442 (Tsaur et al.), and *Research Disclosure*, Vol. 184, August 1979, Item 18431.

While the necessity of limiting patient exposure to high levels of X-radiation was quickly appreciated, the question of patient exposure to even low levels of X-radiation emerged gradually. The separate development of soft tissue radiography, which requires much lower levels of X-radiation, can be illustrated by mammography. The first intensifying screen-film combination (imaging assembly) for mammography was introduced to the public in the early 1970's. Mammography film generally contains a single silver halide emulsion layer and is exposed by a single intensifying screen, usually interposed between the film and the source of X-radiation. Mammography utilizes low energy X-radiation, that is radiation that is predominantly of an energy level less than 40 keV.

U.S. Pat. No. 6,033,840 (Dickerson) and U.S. Pat. No. 6,037,112 (Dickerson) describe asymmetric imaging elements and processing methods for imaging soft tissue.

Problem to be Solved

In mammography, as in many forms of soft tissue radiography, pathological features that are to be identified are often quite small and not much different in density than surrounding healthy tissue. Thus, differences in X-radiation attenuation between normal and diseased soft tissue are very small. Film artifacts and other distracting film features can sometimes interfere with the difficult task of seeing these small differences. Thus, mammography is a very difficult task in medical radiography. Small distractions, such as dye stain, reduce the ability of the user to detect these small differences. As a result, there is a continuing desire to improve the image quality of mammography films, and particularly to reduce dye stain and to increase contrast.

SUMMARY OF THE INVENTION

This invention provides a solution to the noted problems with a radiographic silver halide film that comprises a support having first and second major surfaces and that is capable of transmitting X-radiation, the radiographic silver halide film having disposed on the first major support surface, one or more hydrophilic colloid layers including at least one silver halide emulsion layer, and on the second major support surface, one or more hydrophilic colloid layers including at least one silver halide emulsion layer, at least one of the silver halide emulsion layers comprising cubic silver halide grains that have the same or different composition, at least one of the cubic grain silver halide emulsion layers comprising a combination of first and the second spectral sensitizing dyes that provides a combined maximum J-aggregate absorption on the cubic silver halide grains of from about 540 to about 560 nm, and wherein the first spectral sensitizing dye is an anionic benzimidazole-benzoxazole carbocyanine, the second spectral sensitizing dye is an anionic oxycarbocyanine, and the first and second spectral sensitizing dyes are present in a molar ratio of from about 0.25:1 to about 4:1.

Further, this invention provides a method of providing a black-and-white image comprising exposing a radiographic silver halide film of this invention and processing it, sequentially, with a black-and-white developing composition and a fixing composition, the processing being carried out within 90 seconds, dry-to-dry.

A radiographic imaging assembly of the present invention comprises a radiographic film of this invention that is arranged in association with a fluorescent intensifying screen.

The present invention provides a means for providing radiographic images for mammography exhibiting improved image quality by reducing dye stain while increasing contrast. In addition, all other desirable sensitometric properties are maintained and the radiographic film can be rapidly processed in the same conventional processing equipment and compositions.

These advantages are achieved by using a novel combination of two different spectral sensitizing dyes that exhibit a combined J-aggregate $\lambda_{max}$ of from about 540 to about 560 nm when absorbed to the cubic silver halide grains in at least one of the silver halide emulsion layers.

DETAILED DESCRIPTION OF THE INVENTION

The term "contrast" as herein employed indicates the average contrast derived from a characteristic curve of a radiographic film using as a first reference point (1) a density ($D_1$) of 0.25 above minimum density and as a second reference point (2) a density ($D_2$) of 2.0 above minimum density, where contrast is $\Delta D$ (i.e. 1.75)÷$\Delta\log_{10}E$ ($\log_{10}E_2$-

$\log_{10} E_1$), $E_1$ and $E_2$ being the exposure levels at the reference points (1) and (2).

"Gamma" is described as the instantaneous rate of change of a D logE sensitometric curve or the instantaneous contrast at any logE value.

"Photographic speed" for the radiographic films refers to the exposure necessary to obtain a density of at least 1.0 plus $D_{min}$.

The term "fully forehardened" is employed to indicate the forehardening of hydrophilic colloid layers to a level that limits the weight gain of a radiographic film to less than 120% of its original (dry) weight in the course of wet processing. The weight gain is almost entirely attributable to the ingestion of water during such processing.

The term "rapid access processing" is employed to indicate dry-to-dry processing of a radiographic film in 45 seconds or less. That is, 45 seconds or less elapse from the time a dry imagewise exposed radiographic film enters a wet processor until it emerges as a dry fully processed film.

In referring to grains and silver halide emulsions containing two or more halides, the halides are named in order of ascending concentrations.

"J-aggregate absorption" refers to the light absorption spectral envelope of one or more spectral sensitizing dyes that are absorbed to the surface of the silver halide grains.

The term "equivalent circular diameter" (ECD) is used to define the diameter of a circle having the same projected area as a silver halide grain.

The term "aspect ratio" is used to define the ratio of grain ECD to grain thickness.

The term "coefficient of variation" (COV) is defined as 100 times the standard deviation (a) of grain ECD divided by the mean grain ECD.

The term "covering power" is used to indicate 100 times the ratio of maximum density to developed silver measured in $mg/dm^2$.

The term "dual-coated" is used to define a radiographic film having silver halide emulsion layers disposed on both the front- and backsides of the support. The radiographic silver halide films used in the present invention are "dual-coated."

The term "dynamic range" refers to the range of exposures over which useful images can be obtained (usually having a gamma greater than 2).

The term "fluorescent intensifying screen" refers to a screen that absorbs X-radiation and emits light. A "prompt" emitting fluorescent intensifying screen will emit light immediately upon exposure to radiation while "storage" fluorescent screen can "store" the exposing X-radiation for emission at a later time when the screen is irradiated with other radiation (usually visible light).

The terms "front" and "back" refer to layers, films, or fluorescent intensifying screens nearer to and farther from, respectively, the source of X-radiation.

*Research Disclosure* is published by Kenneth Mason Publications, Ltd., Dudley House, 12 North St., Emsworth, Hampshire P010 7DQ England. This publication is also available from Emsworth Design Inc., 147 West 24th Street, New York, N.Y. 10011.

The radiographic silver halide films of this invention include a flexible support having disposed on both sides thereof, one or more photographic silver halide emulsion layers and optionally one or more non-radiation sensitive hydrophilic layer(s). The silver halide emulsions in the various layers can be the same or different and can comprise mixtures of various silver halide emulsions within the requirements of this invention.

In preferred embodiments, the photographic silver halide film has different silver halide emulsions on opposite sides of the support It is also preferred that the film has a protective overcoat (described below) over the silver halide emulsions on each side of the support.

The support can take the form of any conventional radiographic film support that is X-radiation and light transmissive. Useful supports for the films of this invention can be chosen from among those described in *Research Disclosure*, Sep. 1996, Item 38957 XV. Supports and *Research Disclosure*, Vol. 184, Aug. 1979, Item 18431, XII. Film Supports.

The support is preferably a transparent film support In its simplest possible form the transparent film support consists of a transparent film chosen to allow direct adhesion of the hydrophilic silver halide emulsion layers or other hydrophilic layers. More commonly, the transparent film is itself hydrophobic and subbing layers are coated on the film to facilitate adhesion of the hydrophilic silver halide emulsion layers. Typically the film support is either colorless or blue tinted (tinting dye being present in one or both of the support film and the subbing layers). Referring to *Research Disclosure*, Item 38957, Section XV Supports, cited above, attention is directed particularly to paragraph (2) that describes subbing layers, and paragraph (7) that describes preferred polyester film supports.

Polyethylene terephthalate and polyethylene naphthalate are the preferred transparent film support materials.

In the more preferred embodiments, at least one non-light sensitive hydrophilic layer is included with the one or more silver halide emulsion layers on each side of the film support. This layer may be called an interlayer or overcoat, or both.

Preferably, the "frontside" of the support (first major support surface) comprises one or more silver halide emulsion layers, one of which contains predominantly cubic silver halide grains (that is, at least 50 weight % of all grains) responsive to X-radiation. The cubic silver halide grains particularly contemplated include those having at least 5 mol % chloride (preferably at least 10 and more preferably at least 15 mol % chloride), and up to 95 mol % bromide, based on total silver in a given emulsion layer. Such emulsions include silver halide grains composed of, for example, silver chloride, silver iodochloride, silver bromochloride, silver iodobromochloride, and silver bromoiodochloride. Iodide is generally limited to no more than 1 mol % (based on total silver in the emulsion layer) to facilitate rapid processing. Preferably iodide is from about 0.25 to about 0.75 mol % (based on total silver in the emulsion layer). The cubic silver halide grains in each silver halide emulsion unit (or silver halide emulsion layers) can be the same or different, or mixtures of different types of cubic grains.

The non-cubic silver halide grains in the "frontside" emulsion layers can have any desirable morphology including, but not limited to, cubic, octahedral, tetradecahedral, rounded, spherical or other non-tabular morphologies, or be comprised of a mixture of two or more of such morphologies. Preferably, the cubic silver halide emulsion layers contain at least 80 weight % cubic silver halide grains.

It may also be desirable to employ silver halide grains that exhibit a coefficient of variation (COV) of grain ECD of less than 20% and, preferably, less than 10%. In some embodiments, it may be desirable to employ a grain population that is as highly monodisperse as can be conveniently realized.

The average silver halide grain size (ECD) can vary within each emulsion layer within the film. For example, the average grain size in each radiographic silver halide film is independently and generally from about 0.7 to about 0.9 μm (preferably from about 0.75 to about 0.85 μm), but the average grain size can be different in the various emulsion layers.

The "backside" of the support (second major support surface) also includes one or more silver halide emulsions, preferably at least one of which comprises predominantly tabular silver halide grains. Generally, at least 50% (and preferably at least 80%) of the silver halide grain projected area in this silver halide emulsion layer is provided by tabular grains having an average aspect ratio greater than 5, and more preferably greater than 10. The remainder of the silver halide projected area is provided by silver halide grains having one or more non-tabular morphologies. In addition, the tabular grains are predominantly (at least 90 mol %) bromide based on the total silver in the emulsion layer and can include up to 1 mol % iodide. Preferably, the tabular grains are pure silver bromide.

Tabular grain emulsions that have the desired composition and sizes are described in greater detail in the following patents, the disclosures of which are incorporated herein by reference:

U.S. Pat. No. 4,414,310 (Dickerson), U.S. Pat. No. 4,425,425 (Abbott et at.), U.S. Pat. No. 4,425,426 (Abbott et al.), U.S. Pat. No. 4,439,520 (Kofron et al.), U.S. Pat. No. 4,434,226 (Wilgus et al.), U.S. Pat. No. 4,435,501 (Maskasky), U.S. Pat. No. 4,713,320 (Maskasky), U.S. Pat. No. 4,803,150 (Dickerson et al.), U.S. Pat. No. 4,900,355 (Dickerson et al.), U.S. Pat. No. 4,994,355 (Dickerson et al.), U.S. Pat. No. 4,997,750 (Dickerson et al.), U.S. Pat. No. 5,021,327 (Bunch et al.), U.S. Pat. No. 5,147,771 (Tsaur et al.), U.S. Pat. No. 5,147,772 (Tsaur et al.), U.S. Pat. No. 5,147,773 (Tsaur et al.), U.S. Pat. No. 5,171,659 (Tsaur et al.), U.S. Pat. No. 5,252,442 (Dickerson et al.), U.S. Pat. No. 5,370,977 (Zietlow), U.S. Pat. No. 5,391,469 (Dickerson), U.S. Pat. No. 5,399,470 (Dickerson et al.), U.S. Pat. No. 5,411,853 (Maskasky), U.S. Pat. No. 5,418,125 (Maskasky), U.S. Pat. No. 5,494,789 (Daubendiek et al.), U.S. Pat. No. 5,503,970 (Olm et al.), U.S. Pat. No. 5,536,632 (Wen et al.), U.S. Pat. No. 5,518,872 (King et al.), U.S. Pat. No. 5,567,580 (Fenton et al.), U.S. Pat. No. 5,573,902 (Daubendiek et al.), U.S. Pat. No. 5,576,156 (Dickerson), U.S. Pat. No. 5,576,168 (Daubendiek et al.), U.S. Pat. No. 5,576,171 (Olm et al.), and U.S. Pat. No. 5,582,965 (Deaton et al.). The patents to Abbott et al., Fenton et al., Dickerson, and Dickerson et al. are also cited and incorporated herein to show conventional radiographic film features in addition to gelatino-vehicle, high bromide (≧80 mol % bromide based on total silver) tabular grain emulsions and other features useful in the present invention.

The "backside" of the radiographic silver halide film also preferably includes an antihalation layer disposed over the one or more silver halide emulsion layers. This layer comprises one or more antihalation dyes or pigments dispersed on a suitable hydrophilic binder (described below). In general, such antihalation dyes or pigments are chosen to absorb whatever radiation the film is likely to be exposed to from a fluorescent intensifying screen. For example, pigments and dyes that can be used for antihalation purposes include various water-soluble, liquid crystalline, or particulate magenta or yellow filter dyes or pigments including those described for example in U.S. Pat. No. 4,803,150 (Dickerson et al.), U.S. Pat. No. 5,213,956 (Diehl et al.), U.S. Pat. No. 5,399,690 (Diehl et al.), U.S. Pat. No. 5,922,523 (Helber et al.), U.S. Pat. No. 6,214,499 (Helber et al.), and Japanese Kokai 2-123349, all of which are incorporated herein by reference for pigments and dyes useful in the practice of this invention. One useful class of particulate antihalation dyes includes nonionic polymethine dyes such as merocyanine, oxonol, hemioxonol, styryl, and arylidene dyes as described in U.S. Pat. No. 4,803,150 (noted above) that is incorporated herein for the definitions of those dyes. The magenta merocyanine and oxonol dyes are preferred and the oxonol dyes are most preferred.

The amounts of such dyes or pigments in the antihalation layer would be readily known to one skilled in the art. A particularly useful antihalation dye is the dye M-1 identified below in the Example.

A variety of silver halide dopants can be used, individually and in combination, to improve contrast as well as other common sensitometric properties. A summary of conventional dopants to improve speed, reciprocity and other imaging characteristics is provided by *Research Disclosure*, Item 38957, cited above, Section I. Emulsion grains and their preparation, sub-section D. Grain modifying conditions and adjustments, paragraphs (3), (4), and (5).

A general summary of silver halide emulsions and their preparation is provided by *Research Disclosure*, Item 38957, cited above, Section I. Emulsion grains and their preparation. After precipitation and before chemical sensitization the emulsions can be washed by any convenient conventional technique using techniques disclosed by *Research Disclosure*, Item 38957, cited above, Section III. Emulsion washing.

The emulsions can be chemically sensitized by any convenient conventional technique as illustrated by *Research Disclosure*, Item 38957, Section IV. Chemical Sensitization: Sulfur, selenium or gold sensitization (or any combination thereof) are specifically contemplated. Sulfur sensitization is preferred, and can be carried out using for example, thiosulfates, thiosulfonates, thiocyanates, isothiocyanates, thioethers, thioureas, cysteine or rhodanine. A combination of gold and sulfur sensitization is most preferred.

As noted above, it is essential that at least one of the cubic grain silver halide emulsion layers comprise a combination of one or more first spectral sensitizing dyes and one or more second spectral sensitizing dyes that provide a combined J-aggregate absorption within the range of from about 540 to about 560 nm (preferably from about 545 to about 555 nm) when absorbed on the cubic silver halide grains. The one or more first spectral sensitizing dyes are anionic benzimidazole-benzoxazole carbocyanines and the one or more second spectral sensitizing dyes are anionic oxycarbocyanines.

Preferably, all cubic grain silver halide emulsions in the film contain one or more of these combinations of spectral sensitizing dyes. The combinations of dyes can be the same of different in each emulsion layer. A most preferred combination of spectral sensitizing dyes A-2 and B-1 identified below has a combined J-aggregate absorption $\lambda_{max}$ of about 552 nm when absorbed to cubic silver halide grains.

The first and second spectral sensitizing dyes are provided in a molar ratio of one or more first spectral sensitizing dyes to one or more second spectral sensitizing dyes of from about 0.25:1 to about 4:1, preferably at a molar ratio of from about 0.5:1 to about 1.5:1, and more preferably at a molar ratio of from about 0.75:1 to about 1.25:1. A most preferred combination of spectral sensitizing dyes A-2 and B-1 identified below is a molar ratio of 1:1. The useful total amounts of the first and second dyes in a given silver halide emulsion layer are generally and independently within the range of from about 0.1 to about 1 mmol/mole of silver in the emulsion layer. Optimum amounts will vary with the particular dyes used and a skilled worker in the art would understand how to achieve optimal benefit with the combination of dyes in appropriate amounts. The total amount of both dyes is generally from about 0.25 to about 0.75 mmol/mole of silver.

Preferred "first" spectral sensitizing dyes can be represented by the following Structure I, and preferred "second" spectral sensitizing dyes can be represented by the following Structure II.

I

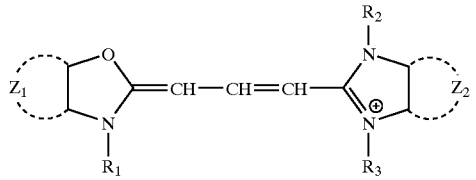

$(X_1^-)n$-1

II

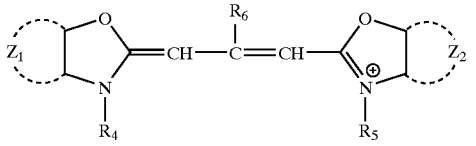

$(X_2^-)n$-1

In both Structure I and II, $Z_1$ and $Z_2$ are independently the carbon atoms that are necessary to form a substituted or unsubstituted benzene or naphthalene ring. Preferably, each of $Z_1$ and $Z_2$ independently represent the carbon atoms necessary to form a substituted or unsubstituted benzene ring.

$X_1^-$and $X_2^-$are independently anions such as halides, thiocyanate, sulfate, perchlorate, p-toluene sulfonate, ethyl sulfate, and other anions readily apparent to one skilled in the art. In addition, "n" is 1 or 2, and it is 1 when the compound is an intermolecular salt.

In Structure I, $R_1$, $R_2$, and $R_3$ are independently alkyl groups having 1 to 10 carbon atoms, alkoxy groups having 1 to 10 carbon atoms, aryl groups having 6 to 10 carbon atoms in the aromatic ring, alkenyl groups having 2 to 8 carbon atoms, and other substituents that would be readily apparent to one skilled in the art. Such groups can be substituted with one or more hydroxy, alkyl, carboxy, sulfo, halo, and alkoxy groups. Preferably, at least one of the $R_1$, $R_2$, and $R_3$ groups comprises at least one sulfo or carboxy group.

Preferably, $R_1$, $R_2$, and $R_3$ are independently alkyl groups having 1 to 4 carbon atoms, phenyl groups, alkoxy groups having 1 to 4 carbon atoms, or alkenyl groups having 2 to 4 carbon atoms. All of these groups can be substituted as described above, and in particular, they can be substituted with a sulfo or carboxy group.

In Structure II, $R_4$ and $R_5$ are independently defined as noted above for $R_1$, $R_2$, and $R_3$. $R_6$ is hydrogen, an alkyl group having 1 to 4 carbon atoms, or a phenyl group, each of which groups can be substituted as described above for the other radicals.

Further details of such spectral sensitizing dyes are provided in U.S. Pat. No. 4,659,654 (Metoki et al.), incorporated herein by reference. These dyes can be readily prepared using known synthetic methods, as described for example in Hamer, *Cyanine Dyes and Related Compounds*, John Wiley & Sons, 1964, incorporated herein by reference.

Representative "first" spectral sensitizing dyes useful in the practice of this invention include the following Compounds A-1 to A-7:

A-1

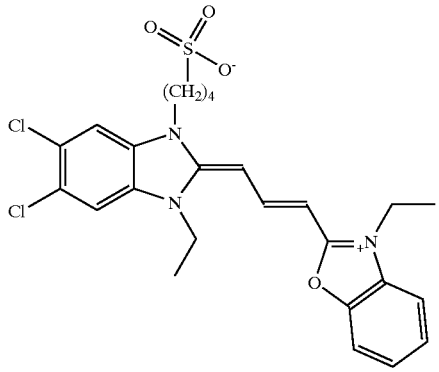

A-2

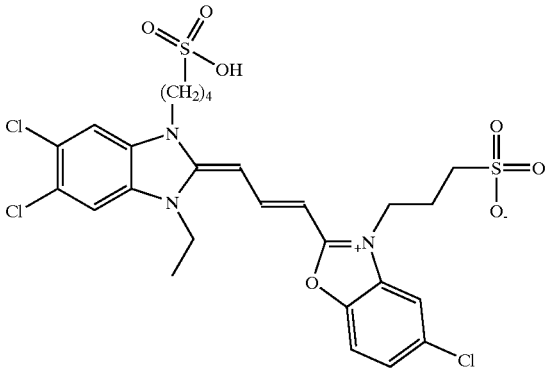

A-3

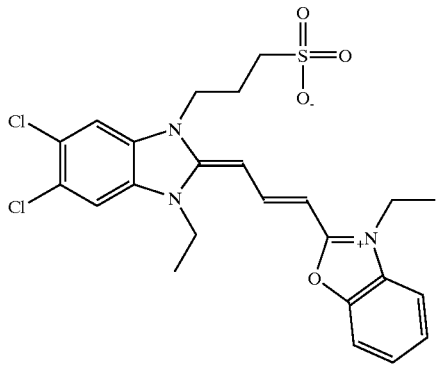

-continued
A-4
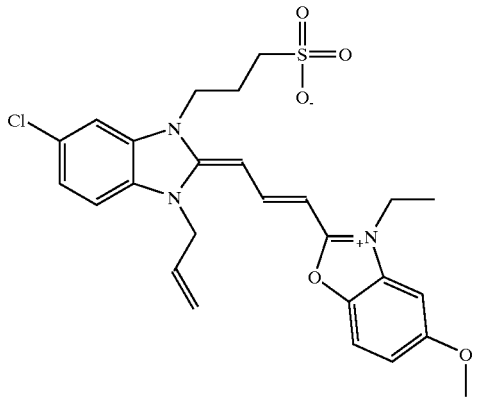
A-5
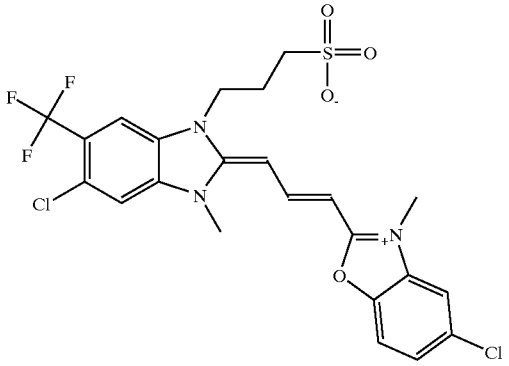
A-6
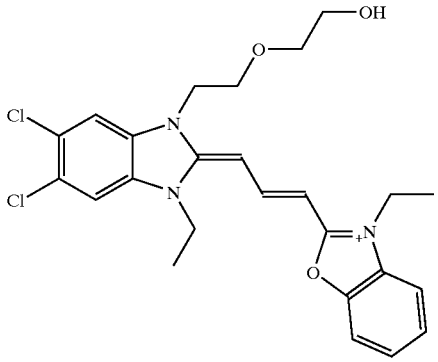
A-7
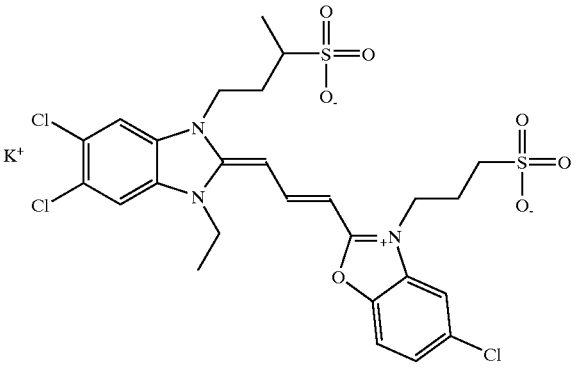
Representative "second" spectral sensitizing dyes useful in the practice of this invention include the following Compounds B-1 to B-5:
B-1
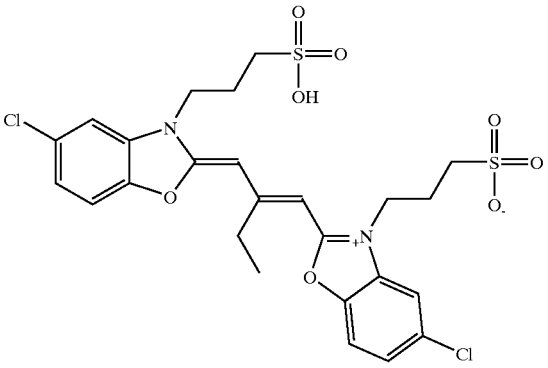
B-2
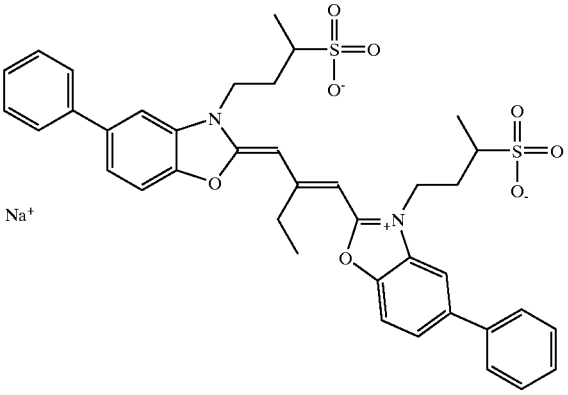
B-3
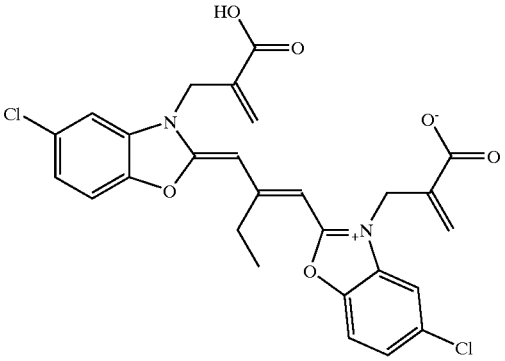
B-4
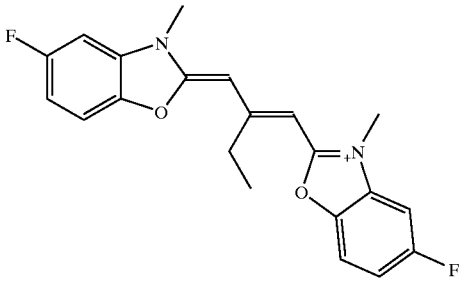

-continued

B-5

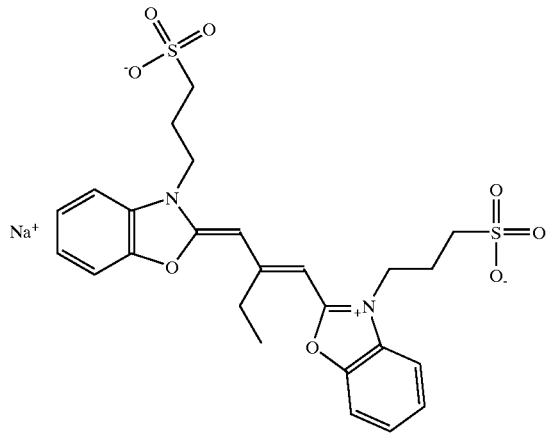

Instability that increases minimum density in negative-type emulsion coatings (that is fog) can be protected against by incorporation of stabilizers, antifoggants, antikinking agents, latent-image stabilizers and similar addenda in the emulsion and contiguous layers prior to coating. Such addenda are illustrated by *Research Disclosure*, Item 38957, Section VII. Antifoggants and stabilizers, and Item 18431, Section II: Emulsion Stabilizers, Antifoggants and Antikinking Agents.

It may also be desirable that one or more silver halide emulsion layers include one or more covering power enhancing compounds adsorbed to surfaces of the silver halide grains. A number of such materials are known in the art, but preferred covering power enhancing compounds contain at least one divalent sulfur atom that can take the form of a —S— or ═S moiety. Such compounds include, but are not limited to, 5-mercapotetrazoles, dithioxotriazoles, mercapto-substituted tetraazaindenes, and others described in U.S. Pat. No. 5,800,976 (Dickerson et al.) that is incorporated herein by reference for the teaching of the sulfur-containing covering power enhancing compounds.

The silver halide emulsion layers and other hydrophilic layers on both sides of the support of the radiographic films of this invention generally contain conventional polymer vehicles (peptizers and binders) that include both synthetically prepared and naturally occurring colloids or polymers. The most preferred polymer vehicles include gelatin or gelatin derivatives alone or in combination with other vehicles. Conventional gelatino-vehicles and related layer features are disclosed in *Research Disclosure*, Item 38957, Section II. Vehicles, vehicle extenders, vehicle-like addenda and vehicle related addenda. The emulsions themselves can contain peptizers of the type set out in Section II, paragraph A. Gelatin and hydrophilic colloid peptizers. The hydrophilic colloid peptizers are also useful as binders and hence are commonly present in much higher concentrations than required to perform the peptizing function alone. The preferred gelatin vehicles include alkali-treated gelatin, acid-treated gelatin or gelatin derivatives (such as acetylated gelatin, deionized gelatin, oxidized gelatin and phthalated gelatin). Cationic starch used as a peptizer for tabular grains is described in U.S. Pat. No. 5,620,840 (Maskasky) and U.S. Pat. No. 5,667,955 (Maskasky). Both hydrophobic and hydrophilic synthetic polymeric vehicles can be used also. Such materials include, but are not limited to, polyacrylates (including polyrnethacrylates), polystyrenes and polyacrylamides (including polymethacrylamides). Dextrans can also be used. Examples of such materials are described for example in U.S. Pat. No. 5,876,913 (Dickerson et al.), incorporated herein by reference.

The silver halide emulsion layers (and other hydrophilic layers) in the radiographic films are generally hardened to various degrees using one or more conventional hardeners.

Conventional hardeners can be used for this purpose, including but not limited to formaldehyde and free dialdehydes such as succinaldehyde and glutaraldehyde, blocked dialdehydes, α-diketones, active esters, sulfonate esters, active halogen compounds, s-triazines and diazines, epoxides, aziridines, active olefins having two or more active bonds, blocked active olefins, carbodiimides, isoxazolium salts unsubstituted in the 3-position, esters of 2-alkoxy-N-carboxydi-hydroquinoline, N-carbamoyl pyridinium salts, carbamoyl oxypyridinium salts, bis(amidino) ether salts, particularly bis(amidino) ether salts, surface-applied carboxyl-activating hardeners in combination with complex-forming salts, carbamoylonium, carbamoyl pyridinium and carbamoyl oxypyridinium salts in combination with certain aldehyde scavengers, dication ethers, hydroxylamine esters of imidic acid salts and chloroformamidinium salts, hardeners of mixed function such as halogen-substituted aldehyde acids (for example, mucochloric and mucobromic acids), onium-substituted acroleins, vinyl sulfones containing other hardening functional groups, polymeric hardeners such as dialdehyde starches, and poly (acrolein-co-methacrylic acid).

The levels of silver and polymer vehicle in the radiographic silver halide films of the present invention are not critical. In general, the total amount of silver on the frontside of the film is at least 40 and no more than 50 mg/dm$^2$ in one or more emulsion layers, and the total amount of silver on the backside of the film is at least 10 mg/dm$^2$ and no more than 15 mg/dm$^2$ in one more emulsion layers. In addition, the total coverage of polymer vehicle on each side of the film is generally and independently at least 30 and no more than 40 mg/dm$^2$. The amounts of silver and polymer vehicle on the two sides of the support in the radiographic silver halide film can be the same or different. These amounts refer to dry weights.

The radiographic silver halide films of this invention generally include a surface protective overcoat disposed on each side of the support that typically provides physical protection of the emulsion layers. Each protective overcoat can be sub-divided into two or more individual layers. For example, protective overcoats can be sub-divided into surface overcoats and interlayers (between the overcoat and silver halide emulsion layers). In addition to vehicle features discussed above the protective overcoats can contain various addenda to modify the physical properties of the overcoats. Such addenda are illustrated by *Research Disclosure*, Item 38957, Section IX. Coating physical property modifying addenda, A. Coating aids, B. Plasticizers and lubricants, C. Antistats, and D. Matting agents. Interlayers that are typically thin hydrophilic colloid layers can be used to provide a separation between the emulsion layers and the surface overcoats. The overcoat on at least one side of the support can also include a blue toning dye or a tetraazaindene (such as 4-hydroxy-6-methyl-1,3,3*a*,7-tetraazaindene) if desired.

The protective overcoat is generally comprised of one or more hydrophilic colloid vehicles, chosen from among the same types disclosed above in connection with the emulsion layers. Protective overcoats are provided to perform two basic functions. They provide a layer between the emulsion layers and the surface of the film for physical protection of the emulsion layer during handling and processing. Secondly, they provide a convenient location for the placement of addenda, particularly those that are intended to modify the physical properties of the radiographic film. The protective overcoats of the films of this invention can perform both these basic functions.

The various coated layers of radiographic silver halide films of this invention can also contain tinting dyes to modify the image tone to transmitted or reflected light. These dyes are not decolorized during processing and may be homogeneously or heterogeneously dispersed in the various layers. Preferably, such non-bleachable tinting dyes are in a silver halide emulsion layer.

Preferred embodiments of this invention include radiographic silver halide films that comprise a transparent film support having first and second major surfaces and that is capable of transmitting X-radiation, the radiographic silver halide films having disposed on the first major support surface, one or more hydrophilic colloid layers including at least one silver halide emulsion layer comprising cubic grains comprising at least 10 mole % silver chloride and from about 0.25 to about 1 mol % silver iodide, both based on total silver halide, and on the second major support surface, one or more hydrophilic colloid layers including at least one tabular grain silver halide emulsion layer, at least one of the cubic grain silver halide emulsion layers comprising a combination of first and second spectral sensitizing dyes that provides a combined maximum J-aggregate absorption of from about 545 to about 555 nm when the dyes are absorbed on the surface of the cubic silver halide grains, wherein the first spectral sensitizing dye is the following Dye A-2, and wherein the second spectral sensitizing dye is following Dye B-1, the first and second spectral sensitizing dyes being present in a molar ratio of from about 0.5:1 to about 1.5:1, and the total spectral sensitizing dyes in the film is from about 0.1 to about 1 mg/mole of silver, the film also comprising a protective overcoat disposed on both sides of the support, and further comprising an antihalation layer disposed on the second major support surface,

A-2

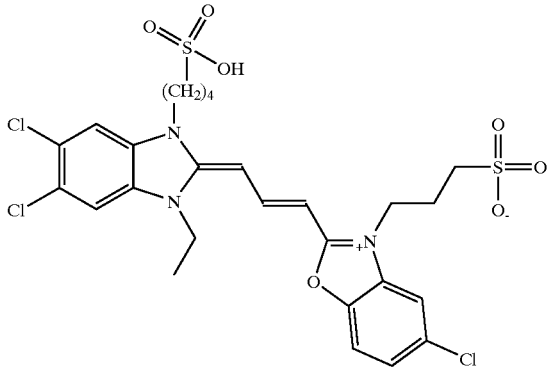

-continued

B-1

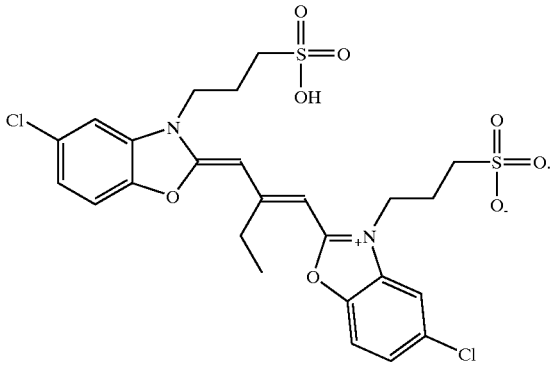

A radiographic imaging assembly of the present invention is composed of one radiographic silver halide film of this invention and one or more fluorescent intensifying screens. Generally, a single fluorescent intensifying screen is used on the frontside for mammography. Fluorescent intensifying screens are typically designed to absorb X-rays and to emit electromagnetic radiation having a wavelength greater than 300 nm. These screens can take any convenient form providing they meet all of the usual requirements for use in radiographic imaging. Examples of conventional, useful fluorescent intensifying screens are provided by *Research Disclosure*, Item 18431, cited above, Section IX. X-Ray Screens/Phosphors, and U.S. Pat. No. 5,021,327 (Bunch et al.), U.S. Pat. No. 4,994,355 (Dickerson et al.), U.S. Pat. No. 4,997,750 (Dickerson et al.), and U.S. Pat. No. 5,108,881 (Dickerson et al.), the disclosures of which are here incorporated by reference. The fluorescent layer contains phosphor particles and a binder, optimally additionally containing a light scattering material, such as titania.

Any conventional or useful phosphor can be used, singly or in mixtures, in the intensifying screens. For example, useful phosphors are described in numerous references relating to fluorescent intensifying screens, including but not limited to, *Research Disclosure*, Vol. 184, August 1979, Item 18431, Section IX, X-ray Screens/Phosphors, and U.S. Pat. No. 2,303,942 (Wynd et al.), U.S. Pat. No. 3,778,615 (Luckey), U.S. Pat. No. 4,032,471 (Luckey), U.S. Pat. No. 4,225,653 (Brixner et al.), U.S. Pat. No. 3,418,246 (Royce), U.S. Pat. No. 3,428,247 (Yocon), U.S. Pat. No. 3,725,704 (Buchanan et al.), U.S. Pat. No. 2,725,704 (Swindells), U.S. Pat. No. 3,617,743 (Rabatin), U.S. Pat. No. 3,974,389 (Ferri et al.), U.S. Pat. No. 3,591,516 (Rabatin), U.S. Pat. No. 3,607,770 (Rabatin), U.S. Pat. No. 3,666,676 (Rabatin), U.S. Pat. No. 3,795,814 (Rabatin), U.S. Pat. No. 4,405,691 (Yale), U.S. Pat. No. 4,311,487 (Luckey et al.), U.S. Pat. No. 4,387,141 (Patten), U.S. Pat. No. 5,021,327 (Bunch et al.), U.S. Pat. No. 4,865,944 (Roberts et al.), U.S. Pat. No. 4,994,355 (Dickerson et al.), U.S. Pat. No. 4,997,750 (Dickerson et al.), U.S. Pat. No. 5,064,729 (Zegarski), U.S. Pat. No. 5,108,881 (Dickerson et al.), U.S. Pat. No. 5,250,366 (Nakajima et al.), U.S. Pat. No. 5,871,892 (Dickerson et al.), EP-A-0 491,116 (Benzo et al.), the disclosures of all of which are incorporated herein by reference with respect to the phosphors.

Exposure and processing of the radiographic silver halide films of this invention can be undertaken in any convenient conventional manner. The exposure and processing techniques of U.S. Pat. Nos. 5,021,327 and 5,576,156 (both noted above) are typical for processing radiographic films. Other processing compositions (both developing and fixing compositions) are described in U.S. Pat. No. 5,738,979 (Fitterman et al.), U.S. Pat. No. 5,866,309 (Fitterman et al.), U.S. Pat. No. 5,871,890 (Fitterman et al.), U.S. Pat. No. 5,935,770 (Fitterman et al.), U.S. Pat. No. 5,942,378 (Fitterman et al.), all incorporated herein by reference. The processing compositions can be supplied as single- or multi-part formulations, and in concentrated form or as more diluted working strength solutions.

Exposing X-radiation is generally directed through a single fluorescent intensifying screen before it passes through the radiographic silver halide film for imaging of soft tissue such as breast tissue.

It is particularly desirable that the radiographic silver halide films be processed within 90 seconds ("dry-to-dry") and preferably within 60 seconds and at least 20 seconds, for the developing, fixing and any washing (or rinsing) steps. Such processing can be carried out in any suitable processing equipment including but not limited to, a Kodak X-OMAT™RA 480 processor that can utilize Kodak Rapid Access processing chemistry. Other "rapid access processors" are described for example in U.S. Pat. No. 3,545,971 (Barnes et al.) and EP 0 248,390A1 (Akio et al.). Preferably, the black-and-white developing compositions used during processing are free of any photographic film hardeners, such as glutaraldehyde.

Radiographic kits can include a radiographic silver halide film or imaging assembly of this invention, and one or more additional fluorescent intensifying screens and/or metal screens, and/or one or more suitable processing compositions (for example black-and-white developing and fixing compositions).

The following example is presented for illustration and the invention is not to be interpreted as limited thereby.

EXAMPLE

Radiographic Film A (Control)

Radiographic Film A was a single-coated film having a silver halide emulsion on one side of a blue-tinted 170 μm transparent poly(ethylene terephthalate) film support and a pelloid layer on the opposite side. The emulsions were chemically sensitized with sulfur and gold, and spectrally sensitized with Dye A-1 noted above.

Radiographic Film A had the following layer arrangement:

Overcoat
Interlayer
Emulsion Layer
Support
Pelloid Layer
Overcoat

The noted layers were prepared from the following formulations.

| | Coverage (mg/dm$^2$) |
|---|---|
| Overcoat Formulation | |
| Gelatin vehicle | 4.4 |
| Methyl methacrylate matte beads | 0.35 |
| Carboxymethyl casein | 0.73 |
| Colloidal silica (LUDOX AM) | 1.1 |
| Polyacrylamide | 0.85 |
| Chrome alum | 0.032 |
| Resorcinol | 0.073 |

-continued

| | Coverage (mg/dm$^2$) |
|---|---|
| Dow Corning Silicone | 0.153 |
| TRITON X-200 surfactant (from Union Carbide) | 0.26 |
| LODYNE S-100 surfactant (from Ciba Specialty Chem.) | 0.0097 |
| Interlayer Formulation | |
| Gelatin vehicle | 4.4 |
| Emulsion Layer Formulation | |
| Cubic grain emulsion [AgBr 0.85 μm average size] | 51.1 |
| Gelatin vehicle | 34.9 |
| Spectral sensitizing dye A-1 | 250 mg/Ag mole |
| 4-Hydroxy-6-methyl-1,3,3a,7-tetraazaindene | 1 g/Ag mole |
| Maleic acid hydrazide | 0.0075 |
| Catechol disulfonate | 0.42 |
| Glycerin | 0.22 |
| Potassium bromide | 0.14 |
| Resorcinol | 2.12 |
| Bisvinylsulfonylmethane | 0.4% based on total gelatin in all layers on same side |
| Pelloid Layer | |
| Gelatin | 43 |
| Dye C-1 noted below | 0.31 |
| Dye C-2 noted below | 0.11 |
| Dye C-3 noted below | 0.13 |
| Dye C-4 noted below | 0.12 |
| Bisvinylsulfonylmethane | 0.4% based on total gelatin in all layers on same side |

C-1

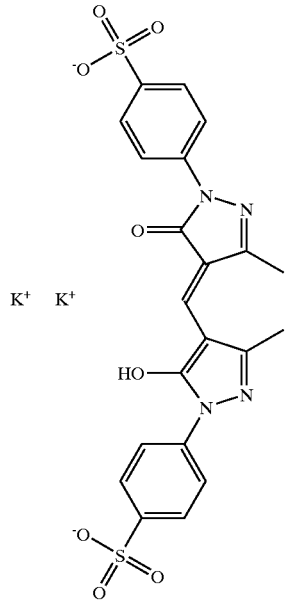

-continued

C-2

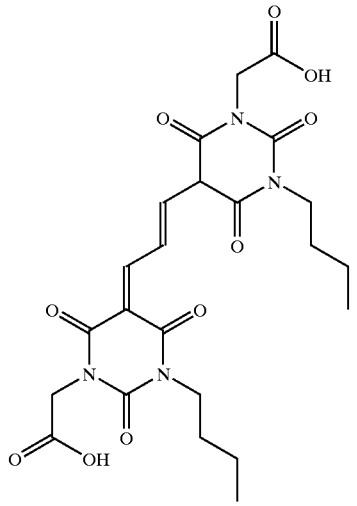

C-3

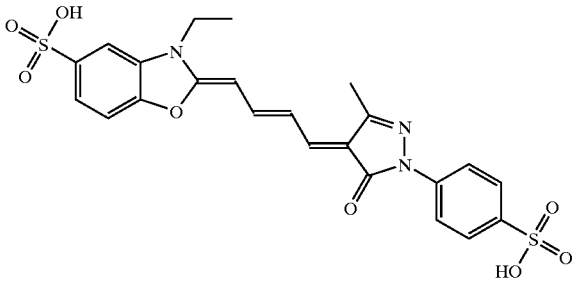

C-4

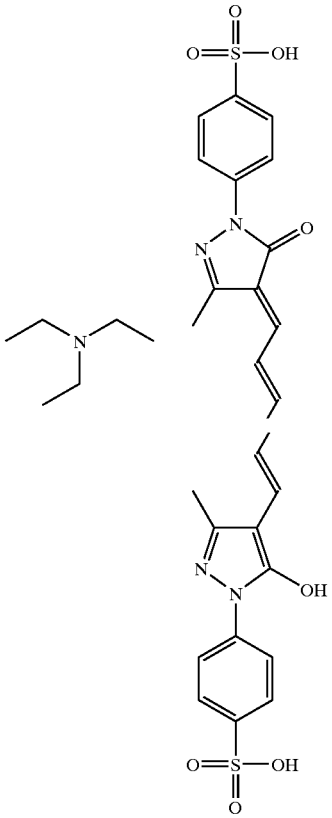

Radiographic Film B (Control)

Radiographic Film B was a dual-coated radiographic film with ⅔ of the silver and gelatin coated on one side of the support and the remainder coated on the opposite side of the support. It also included a halation control layer containing solid particle dyes to provide improved sharpness. The film contained a green-sensitive, high aspect ratio tabular silver bromide grain emulsion on one side of the support. Thus, at least 50% of the total grain projected area was accounted for by tabular grains having a thickness of less than 0.3 μm and having an average aspect ratio greater than 8:1. The emulsion was polydisperse in distribution and had a coefficient of variation of 38. The emulsion was spectrally sensitized with anhydro-5,5-dichloro-9-ethyl-3,3'-bis(3-sulfopropyl)-oxacarbocyanine hydroxide (680 mg/Ag mole), followed by potassium iodide (300 mg/Ag mole). Film B had the following layer arrangement and formulations on the film support:

Overcoat 1
Interlayer
Emulsion Layer 1
Support
Emulsion Layer 2
Halation Control Layer
Overcoat 2

| | Coverage (mg/dm$^2$) |
|---|---|
| Overcoat 1 Formulation | |
| Gelatin vehicle | 4.4 |
| Methyl methacrylate matte beads | 0.35 |
| Carboxymethyl casein | 0.73 |
| Colloidal silica (LUDOX AM) | 1.1 |
| Polyacrylamide | 0.85 |
| Chrome alum | 0.032 |
| Resorcinol | 0.73 |
| Dow Corning Silicone | 0.153 |
| TRITON X-200 surfactant | 0.26 |
| LODYNE S-100 surfactant | 0.0097 |
| Interlayer Formulation | |
| Gelatin vehicle | 4.4 |
| Emulsion Layer 1 Formulation | |
| Cubic grain emulsion [AgBr 0.85 μm average ECD] | 40.3 |
| Gelatin vehicle | 29.6 |
| 4-Hydroxy-6-methyl-1,3,3a,7-tetraazaindene | 1 g/Ag mole |
| 1-(3-Acetamidophenyl)-5-mercaptotetrazole | 0.026 |
| Maleic acid hydrazide | 0.0076 |
| Catechol disulfonate | 0.2 |
| Glycerin | 0.22 |
| Potassium bromide | 0.13 |
| Resorcinol | 2.12 |
| Bisvinylsulfonylmethane | 0.4% based on total gelatin in all layers on same side |
| Emulsion Layer 2 Formulation | |
| Tabular grain emulsion [AgBr 2.9 × 0.10 μm average size] | 10.7 |
| Gelatin vehicle | 16.1 |
| 4-Hydroxy-6-methyl-1,3,3a,7-tetraazaindene | 2.1 g/Ag mole |
| 1-(3-Acetamidophenyl)-5-mercaptotetrazole | 0.013 |
| Maleic acid hydrazide | 0.0032 |
| Catechol disulfonate | 0.2 |
| Glycerin | 0.11 |

-continued

| | Coverage (mg/dm$^2$) |
|---|---|
| Potassium bromide | 0.06 |
| Resorcinol | 1.0 |
| Bisvinylsulfonylmethane | 2% based on total gelatin in all layers on same side |
| Halation Control Layer | |
| Magenta filter dye M-1 (noted below) | 2.2 |
| Gelatin | 10.8 |
| Overcoat 2 Formulation | |
| Gelatin vehicle | 8.8 |
| Methyl methacrylate matte beads | 0.14 |
| Carboxymethyl casein | 1.25 |
| Colloidal silica (LUDOX AM) | 2.19 |
| Polyacrylamide | 1.71 |
| Chrome alum | 0.066 |
| Resorcinol | 0.15 |
| Dow Corning Silicone | 0.16 |
| TRITON X-200 surfactant | 0.26 |
| LODYNE S-100 surfactant | 0.01 |

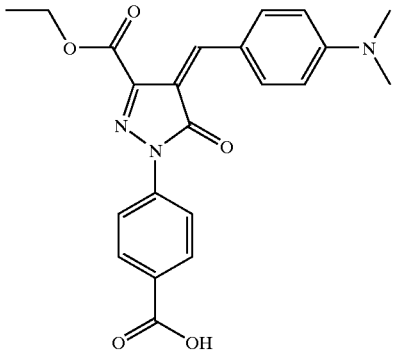

M-1

Radiographic Film C (Control)

Film C was like Film B except that a AgIClBr (0.5:15:84:5 molar ratio) cubic grain emulsion was used in the front Emulsion Layer 1 and was spectrally sensitized using Dye A-1 noted above.

Radiographic Film C (Control)

Film C was like Film B except that a AgIClBr (0.5:15:84:5 molar ratio) cubic grain emulsion was used in the front Emulsion Layer 1 and was spectrally sensitized using Dye A-1 noted above.

Radiographic Film D (Invention)

Film D was like Film C except that the front emulsion layer contained a mixture of spectral sensitizing dyes A-2 and B-1 (both noted above), each at 170 mg/mole of silver.

Samples of the films were exposed through a graduated density step tablet to a MacBeth sensitometer for 0.5 second to a 500-watt General Electric DMX projector lamp that was calibrated to 2650°K filtered with a Corning C4010 filter to simulate a green-emitting X-ray screen exposure.

The film samples were then processed using a processor commercially available under the trademark KODAK RP X-OMAT™film Processor M6A-N, M6B, or M35A. Development was carried out using the following black-and-white developing composition:

| | |
|---|---|
| Hydroquinone | 30 g |
| Phenidone | 1.5 g |
| Potassium hydroxide | 21 g |

-continued

| | |
|---|---|
| $NaHCO_3$ | 7.5 g |
| $K_2SO_3$ | 44.2 g |
| $Na_2S_2O_5$ | 12.6 g |
| Sodium bromide | 35 g |
| 5-Methylbenzotriazole | 0.06 g |
| Glutaraldehyde | 4.9 g |
| Water to 1 liter, pH 10 | |

The film samples were processed for less than 90 seconds. Fixing was carried out using KODAK RP X-OMAT®LO Fixer and Replenisher fixing composition (Eastman Kodak Company).

Optical densities are expressed below in terms of diffuse density as measured by a conventional X-rite Model 310TM densitometer that was calibrated to ANSI standard PH 2.19 and was traceable to a National Bureau of Standards calibration step tablet. The characteristic D vs. logE curve was plotted for each radiographic film that was imaged and processed. Speed was measured at a density of 1.4+$D_{min}$. Gamma (contrast) is the slope (derivative) of the noted curves.

Residual dye stain was measured using spectrophotometric methods and calculated as the difference between density at 505 nm that corresponds to the dye absorption peak, and the density at 700 nm. This measurement corrects for differences in film fog. Measurements were done on film samples that have been processed without exposure and are nominally clear off developed silver except for fog silver. Processing was carried out in an RP X-OMAT Processor Model 480RA using KODAK RA30 Developer and KODAK LO Fixer.

The following TABLE I shows the relative sensitometry of Films A-D. All four films provided similar photographic speed. Control Film B provided improved dye stain compared to Control Film A because of layer structure. However, Control Film C did not provided improved dye stain over Control Film B since it contained the same spectral sensitizing dye. Only Invention Film D provided significant improvement in dye stain compared to the Control Films A-C and provided improved contrast over Control Films A and B.

TABLE I

| Film | Spectral Sensitizing Dye | Speed | Contrast | Dye Stain |
|---|---|---|---|---|
| A (Control) | A-1 | 416 | 3.4 | 0.08 |
| B (Control) | A-1 | 421 | 3.5 | 0.06 |
| C (Control) | A-1 | 421 | 4.1 | 0.06 |
| D (Invention) | A-2 and B-1 | 416 | 4.0 | 0.04 |

The invention has been described in detail with particular reference to preferred embodiments thereof, but it will be understood that variations and modifications can be effected within the spirit and scope of the invention.

We claim:

1. A radiographic silver halide film that comprises a support having first and second major surfaces and that is capable of transmitting X-radiation, said radiographic silver halide film having disposed on said first major support surface, one or more hydrophilic colloid layers including at least one silver halide emulsion layer, and on said second major support surface, one or more hydrophilic colloid layers including at least one silver halide emulsion layer, at least one of said silver halide emulsion layers comprising cubic silver halide grains that have the same or different composition and comprise at least 5 mol % chloride, and no more than 1 mol % silver iodide, based on total silver in the emulsion, at least one of said cubic grain silver halide emulsion layers comprising a combination of first and second spectral sensitizing dyes that provides a combined maximum J-aggregate absorption on said cubic silver halide grains of from about 540 to about 560 nm, and wherein said first spectral sensitizing dye is an anionic benzimidazole-benzoxazole carbocyanine, said second spectral sensitizing dye is an anionic oxycarbocyanine, said first and second spectral sensitizing dyes are present in a molar ratio of from about 0.25:1 to about 4:1.

2. The radiographic silver halide film of claim 1 wherein said cubic silver halide grains are composed of at least 10 mol % chloride, both based on total silver in the emulsion.

3. The radiographic silver halide film of claim 2 wherein said cubic silver halide grains are independently composed of at least 15 mol % chloride, based on total silver in the emulsion, and from about 0.25 to about 0.75 mol % iodide, based on total silver in the emulsion.

4. The radiographic silver halide film of claim 1 wherein said cubic silver halide grains have an average size (ECD) of from about 0.7 to about 0.9 $\mu$m.

5. The radiographic silver halide film of claim 1 wherein at least one silver halide emulsion layer on said second major support surface comprises predominantly tabular silver halide grains.

6. The radiographic silver halide film of claim 1 wherein both said first and second films further comprise a protective overcoat disposed on said silver halide emulsion on each side of their film supports.

7. The radiographic silver halide film of claim 1 further comprising an antihalation layer disposed on said second major support surface.

8. The radiographic silver halide film of claim 1 comprising a polymer vehicle on either side of said support is the same or different total amount of from about 30 to about 40 mg/dm$^2$, the level of silver on the front side is from about 40 to about 50 mg/dm$^2$, and a level of silver on the back side is from about 10 to about 15 mg/dm$^2$.

9. The radiographic silver halide film of claim 1 wherein said first spectral sensitizing dye is represented by the following Structure I:

(I)

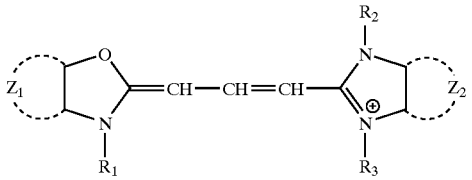

$(X_1^-)n$-1 wherein $Z_1$, and $Z_2$ represent the carbon atoms necessary to form a substituted or unsubstituted benzene or naphthalene ring, $R_1$, $R_2$, and $R_3$ are independently substituted or unsubstituted alkyl, alkoxy, aryl, or alkenyl groups, $X_1^-$ is an anion, and n is 1 or 2.

10. The radiographic silver halide film of claim 1 wherein said second spectral sensitizing dye is represented by the following Structure II:

(II)

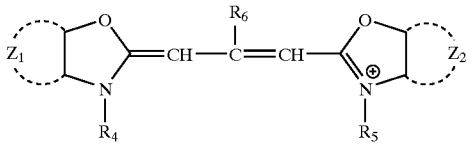

$(X_2^-)n$-1 wherein $Z_1$, and $Z_2$ represent the carbon atoms necessary to form a substituted or unsubstituted benzene or naphthalene ring, $R_4$ and $R_5$ are independently substituted or unsubstituted alkyl, alkoxy, aryl, or alkenyl groups, $R_6$ is hydrogen or a substituted or unsubstituted alkyl or phenyl group, $X_2^-$ is an anion, and n is 1 or 2.

11. The radiographic silver halide film of claim 1 wherein the total amount of said combination of said first and second spectral sensitizing dyes is from about 0.25 to about 0.75 mol/mole of silver.

12. The radiographic silver halide film of claim 1 wherein said first and second spectral sensitizing dyes are present in a molar ratio of from about 0.5:1 to about 1.5:1.

13. The radiographic silver halide film of claim 1 wherein said combination of said first and second spectral sensitizing dyes provide a combined J-aggregate absorption of from about 545 to about 555 nm when said dyes are absorbed on said cubic silver halide grains.

14. The radiographic silver halide film of claim 1 wherein the amount of said first and second spectral sensitizing dyes present in a silver halide emulsion layer is independently from about 0.1 to about 1 mmol/mole of silver.

15. The radiographic silver halide film of claim 1 wherein said first spectral sensitizing dye is selected from the following Compounds A-1 to A-7, and the second spectral sensitizing dye is selected from the following Compounds B-1 to B-5:

A-1

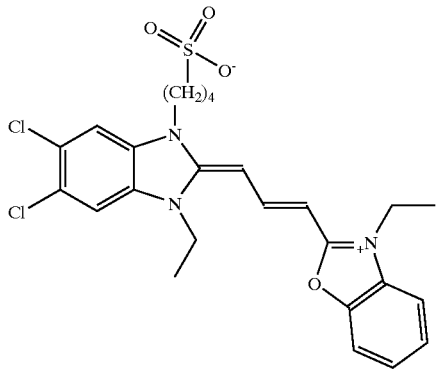

-continued
A-2
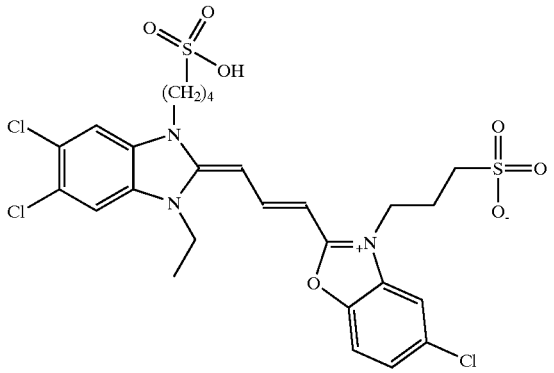
A-3
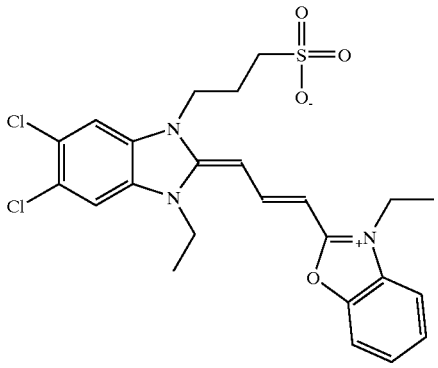
A-4
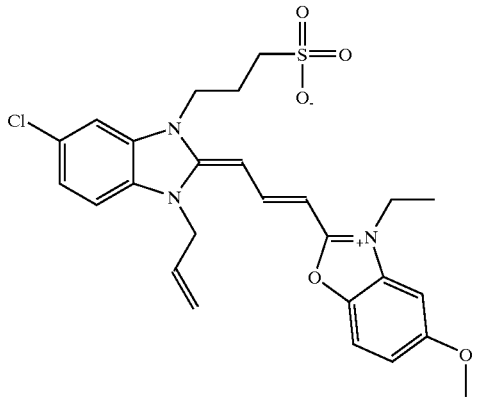
A-5
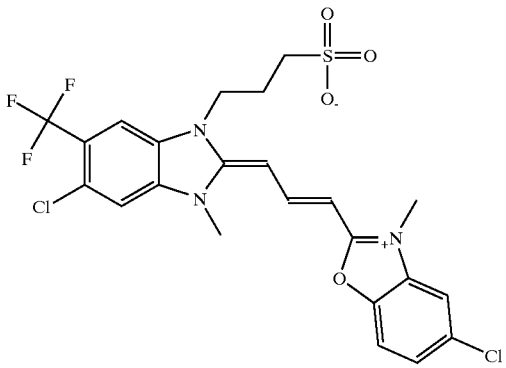
-continued
A-6
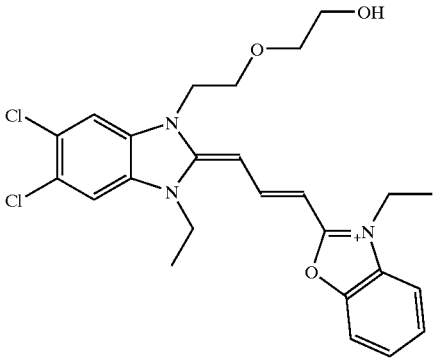
A-7
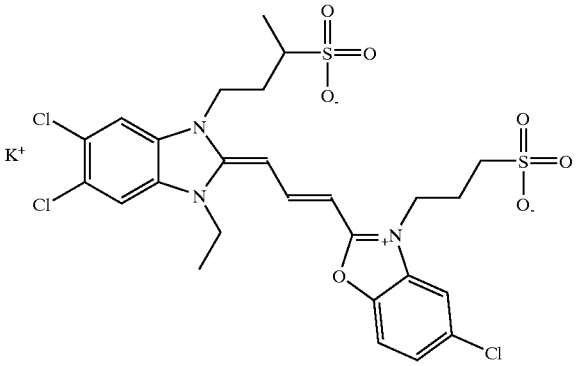
B-1
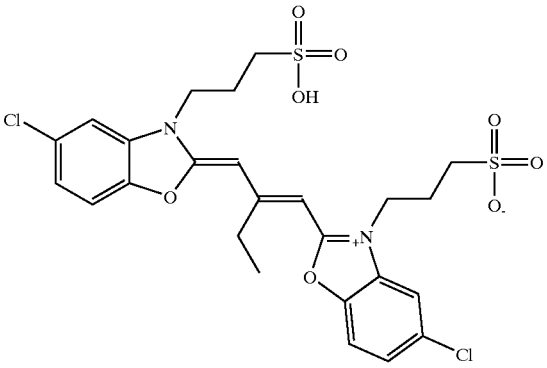
B-2
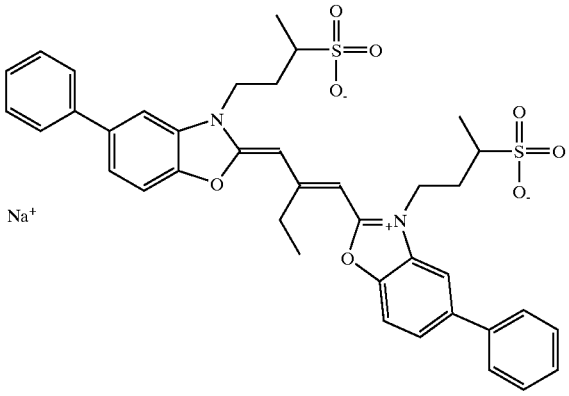

-continued

B-3

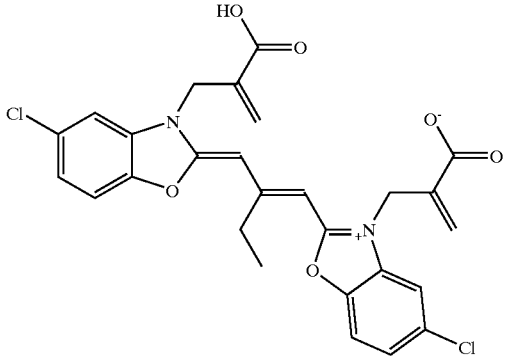

B-4

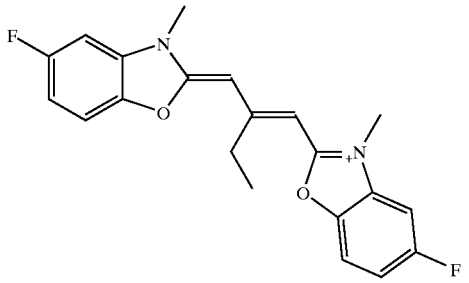

B-5

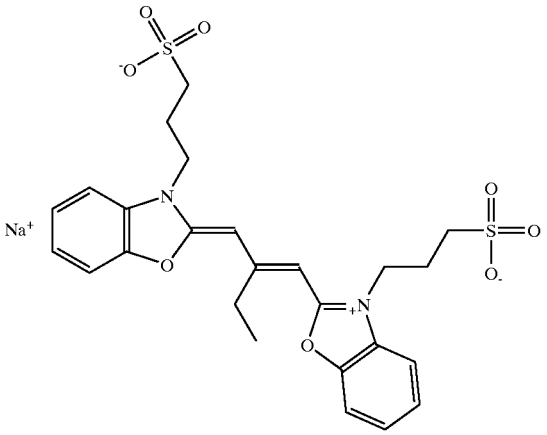

16. The radiographic silver halide film of claim 15 wherein said first spectral sensitizing dye is the following Dye A-2 and said second spectral sensitizing dye is the following Dye B-1:

A-2

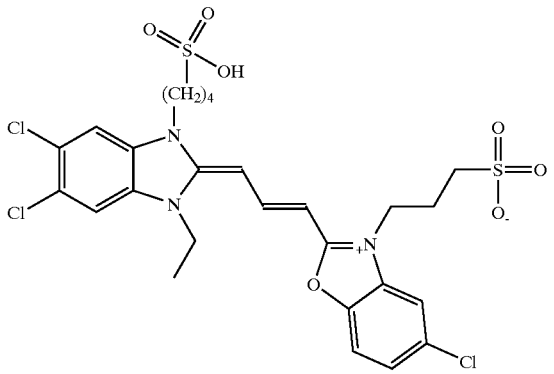

-continued

B-1

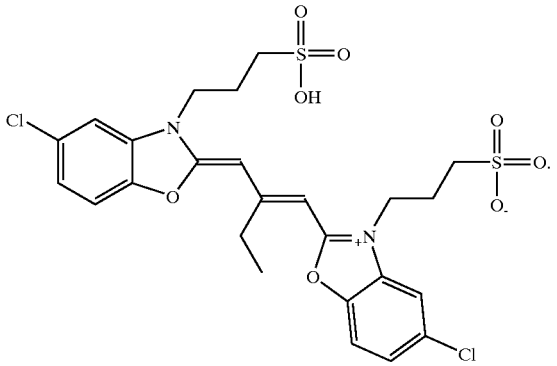

17. A radiographic silver halide film having a photographic speed of at least 100 and comprising a transparent film support having first and second major surfaces and that is capable of transmitting X-radiation, said radiographic silver halide film having disposed on said first major support surface, one or more hydrophilic colloid layers including at least one silver halide emulsion layer comprising cubic grains comprising at least 10 mole % silver chloride and from about 0.25 to about 1 mol % silver iodide, both based on total silver halide, and on said second major support surface, one or more hydrophilic colloid layers including at least one tabular grain silver halide emulsion layer, said cubic grain silver halide emulsion layer comprising a combination of first and second spectral sensitizing dyes that provides a combined maximum J-aggregate absorption of from about 545 to about 555 nm when said dyes are absorbed on the surface of said cubic silver halide grains, wherein said first spectral sensitizing dye is the following Dye A-2, and wherein said second spectral sensitizing dye is following Dye B-1, said first and second spectral sensitizing dyes being present in a molar ratio of from about 0.5:1 to about 1.5:1, and the total spectral sensitizing dyes in said film is from about 0.25 to about 0.75 mg/mole of silver, said film also comprising a protective overcoat layer disposed on both sides of said support, and further comprising an antihalation layer disposed on said second major support surface,

A-2

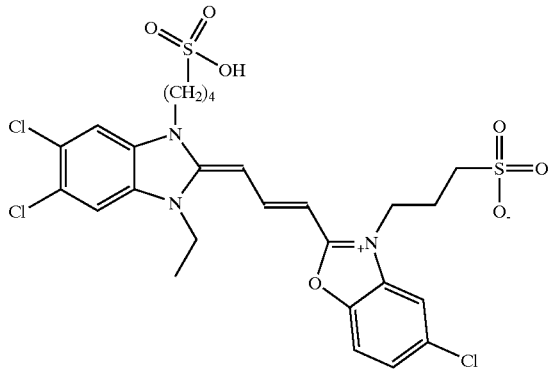

-continued

B-1

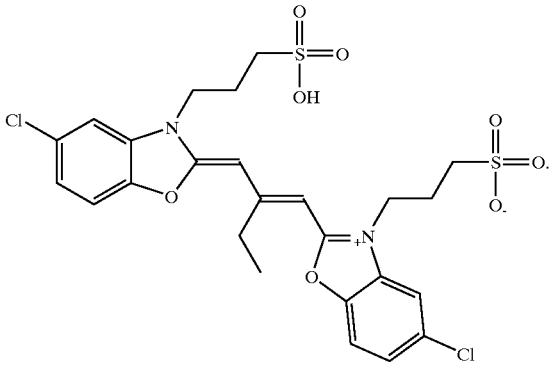

18. A radiographic imaging assembly comprising the radiographic silver halide film of claim 1 arranged in association with a fluorescent intensifying screen.

19. The radiographic imaging assembly of claim 18 comprising a single fluorescent intensifying screen.

20. A method of providing a black-and-white image comprising exposing the radiographic silver halide film of claim 1 and processing it, sequentially, with a black-and-white developing composition and a fixing composition, the processing being carried out within 90 seconds, dry-to-dry.

21. The method of claim 20 wherein said black-and-white developing composition is free of any photographic film hardeners.

22. The method of claim 20 that is carried out for 60 seconds or less.

* * * * *